United States Patent [19]

Ferguson

[11] Patent Number: 4,779,171

[45] Date of Patent: Oct. 18, 1988

[54] KEYHOLE AND ROOM ILLUMINATING APPARATUS

[76] Inventor: Larry D. Ferguson, Rte. 1, Box 128C, Springhill, La. 71075

[21] Appl. No.: 886,825

[22] Filed: Jul. 18, 1986

[51] Int. Cl.[4] ..... E0JB 17/10

[52] U.S. Cl. ..... 362/100; 362/191; 362/234

[58] Field of Search ..... 362/100, 190, 191, 152, 362/184, 196, 802, 253, 234, 145

[56] References Cited

U.S. PATENT DOCUMENTS

| | | | |
|---|---|---|---|
| 1,961,865 | 6/1934 | Remington | 362/100 |
| 2,011,692 | 8/1935 | Simpson | 362/100 |
| 2,709,745 | 5/1955 | Sundt | 362/100 |
| 2,927,197 | 3/1960 | Phillips et al. | 362/100 |
| 3,787,677 | 1/1974 | Molitor | 362/100 |
| 4,475,067 | 10/1984 | Rome | 362/100 |

*Primary Examiner*—Ira S. Lazarus
*Assistant Examiner*—D. M. Cox
*Attorney, Agent, or Firm*—John M. Harrison

[57] ABSTRACT

A keyhole and room illuminating apparatus which is characterized by a split housing having side and bottom openings and bulbs positioned inside the housing at the openings, with electrical connectors and batteries disposed inside the housing for operating the bulbs by manipulating a switch located in the housing. The keyhole and room illuminating apparatus is designed to illuminate the keyhole provided in the door lockset, as well as the room into which the door is opened.

2 Claims, 1 Drawing Sheet

KEYHOLE AND ROOM ILLUMINATING APPARATUS

BACKGROUND OF THE INVENTION

1. Field of the Invention

This invention relates to a keyhole illuminating apparatus and more particularly, to a combined keyhole and room illuminating apparatus which is characterized by a split housing containing openings or apertures in the side and bottom thereof, with bulbs located in the apertures. Batteries, electrical connectors and a switch are positioned in the housing for powering the bulbs and illuminating both the keyhole in the door lockset and the interior of the room when the door is opened into the room. In a preferred emodiment of the invention the split housing is characterized by a tongue-and-groove connection, wherein the housing can be easily opened to replace the batteries or bulbs or to replace or maintain the electrical connectors. In another preferred embodiment of the invention the keyhole and room illuminating apparatus is provided with an adjustable attachment plate for adjustably securing the apparatus to the door of a structure.

2. Description of the Prior Art

Various types of keyhole illuminating devices are known in the art. Typical of these devices is the "Keyhole Illuminator With Sliding Switch" disclosed in U.S. Pat. No. 2,562,687, dated July 31, 1951, to E. J. Anderson. This device is characterized by a housing having an electric light bulb therein and provided with a flexible, transparent sheet closing the housing to protect the device from the elements. An electric switch adapted to be operated by flexure of the transparent sheet is provided to establish a closed lighting circuit to the bulb. The housing is typically mounted in the door facing adjacent to the keyhole opening in a lockset, in order to illuminate the lockset by manipulation of the switch. A "Keyhole Lighting Device" is disclosed in U.S. Pat. No. 2,699,490, dated Jan. 11, 1955, to J. D. Reap, Jr. This device includes a self-contained lighting unit which is attached to a door near the keyhole of a lockset. The device includes a bulb and battery combination located in a casing, the switch of which is concealed in order to be accessible only to one understanding the keyhole lighting device structure and operation of the device. The lamp or light is so situated as to illuminate the keyhole opening when the hidden switch is activated. U.S. Pat. No. 2,732,480, dated Jan. 24, 1956, to W. M. Wells, II, discloses a "Utility Lamp" which includes a casing that is shiftable with respect to a support. The casing forms one lead of a circuit between a battery and a bulb carried in the casing and is provided with insulated end portions. The casing engages a spring contact means, whereby when shifted with respect to the spring contact means, the casing forms a complete circuit between the battery and the bulb. The casing and bulb combination are mounted to a door in close proximity to the keyhole in the lockset, in order to illuminate the keyhole when the utility lamp is activated. A "Door Lock Illuminator" is disclosed in U.S. Pat. No. 2,813,195, dated Nov. 12, 1957, to R. M. Willey, et, al. This device is characterized by a casing containing batteries and a bulb, which casing is mounted to a door facing with the bulb facing the door knob and keyhole of a lockset. The beam of light from the bulb is directed at an angle of 45° to fully illuminate the knob and lock and is operated by batteries. The illuminator is controlled by the outside screen or weather door, with the light illuminated only when the screen or weather door is opened, in order to illuminate the lockset and the door knob. U.S. Pat. No. 2,790,068, dated Apr. 23, 1957, to C. F. Ruscitti, discloses a "Keyhole Illuminator" which is mounted to a door facing adjacent the keyhole in a lockset. The keyhole illuminator includes a casing containing batteries and a light bulb with the light bulb mounted in angular relationship adjacent a port which faces the lockset, in order to illuminate the lockset when the bulb is illuminated. The device is activated by a foot control switch which leaves the hands free for unlocking the door. Another "Keyhole Illuminator" is disclosed in U.S. Pat. No. 2,927,197, dated Mar. 1, 1960, to C. M. Phillips, et, al. This device is characterized by a self-contained lamp and lamp energizing means which is attached to a door adjacent to the door lock. The device includes a switch which controls the illumination and extends about the keyhole plate of the lock, such that bringing the hand in which the key is grasped up to the approximate location of the lock automatically brings the hand into contact with the control member which illuminates the lock. A "Keyhole Illuminating Device with Time Delay" is disclosed in U.S. Pat. No. 3,590,234, dated June 29, 1971, to Alfred M. Bartick. This device includes a casing with an opening at one end and an illuminating element mounted in the casing and extending interiorally of the opening for directing light toward the keyhole. A battery is mounted in the casing and is connected in a series circuit with the illuminating element. A vacuum cup delay push button actuator which includes an electrical contact member for temporarily energizing the circuit is provided to automatically deactivate the circuit after expiration of a predetermined period of time. A "Battery Operated Illuminating Device" is disclosed in U.S. Pat. No. 4,293,894, dated Oct. 6, 1981, to Nolan D. Blank. This device is characterized by a frusto-conical housing shaped for mounting to a surface adjacent the object to be illuminated and the housing includes an integrally formed, depressible portion for operating a switch within the housing. A lens provided in the side of the housing is shaped for illumination of the desired object and an electronic sub-assembly located within the housing is operable by the switch upon a single depression, with an electronic time-delay provided for deenergizing a bulb. U.S. Pat. No. 4,281,368, dated July 28, 1981, to A. Robert Humbert, discloses another "Keyhole Illuminating Apparatus". This device is characterized by a tubular housing having a threaded base bulb at one end and a "Penlite" battery located within the housing, with a positive terminal stud separated from the positive terminal of the bulb by a helical compression spring. The spring coils receive the lamp base and the spring is bottomed and centered in an annular retainer disk encircling the positive terminal stud of the battery. A conductive strap engages the end coil of the spring and extends the length of the battery to its base, providing electrical continuity from the negative terminal of the battery to the threaded base of the bulb. A push button which is accessible at the end of the housing moves the battery so that the positive battery terminal engages the positive terminal of the bulb.

OBJECTS OF THE INVENTION

It is an object of this invention to provide a new and improved illuminating apparatus for mounting on a door, which apparatus is capable of illuminating the keyhole of a lockset provided in the door and the interior of the room closed by the door, when the door is opened into the room.

Another object of the invention is to provide a keyhole and room illuminating apparatus which is adjustably secured to a door and is provided with two light bulbs, one of which bulbs illuminates the keyset and keyhole to facilitate insertion of a key and the other of which illuminates the interior of the room when the door is opened.

A still further object of the invention is to provide a new and improved illuminating apparatus which is constructed so as to be easily assembled and disassembled and is provided with two light bulbs powered by batteries, one of which bulbs is oriented downwardly to illuminate the keyhole and lockset of the door and the other horizontally oriented in order to illuminate the interior of the room when the door is opened.

Yet another object of the invention is to provide a keyhole and room illuminating device which is characterized by a split housing, with one element of the split housing adjustably connected to an attachment plate secured to the door and containing batteries, a vertically oriented light bulb for illuminating a keyhole provided in a door lockset, a horizontally oriented light bulb for illuminating the room into which the door is opened, electrical connectors joining the light bulbs and batteries and a switch provided in slidable contact with the connectors for illuminating the bulbs.

SUMMARY OF THE INVENTION

These and other objects of the invention are provided in a new and improved keyhole and room illuminating apparatus which is adjustably mounted to the door of a room and is characterized by a split housing for easy maintenance and replacement of batteries and a pair of light bulbs, one of which bulbs is vertically oriented in the housing to illuminate the keyset and keyhole in the door and the other horizontally mounted in the housing to illuminate the interior of the room when the door is opened.

BRIEF DESCRIPTION OF THE DRAWING

The invention will be better understood by reference to the accompanying drawing, wherein.

DESCRIPTION OF THE PREFERRED EMBODIMENTS

Figure 1:
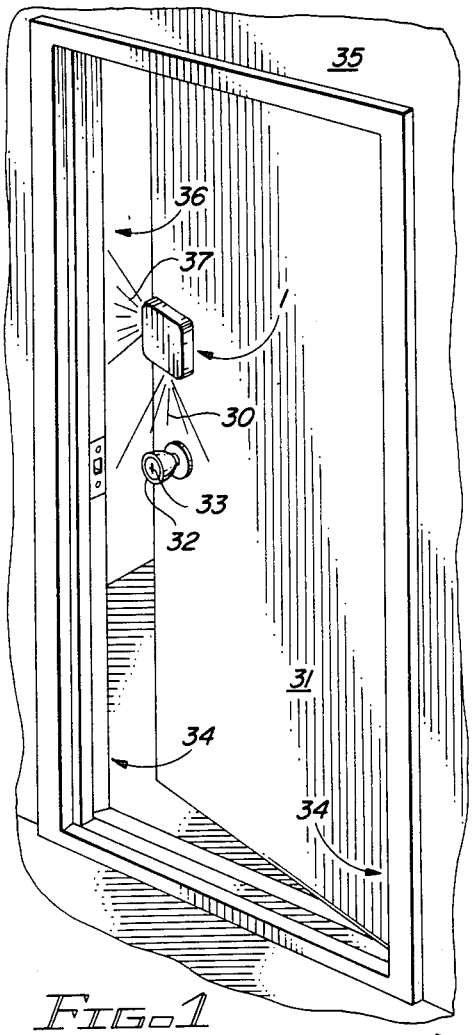
FIG. 1 is a perspective view of the keyhole and room illuminating apparatus mounted to a door, with the door partially opened into a room.

Referring initially to FIG. 1 of the drawing the illuminating apparatus of this invention is generally illustrated by reference numeral 1. The illuminating apparatus 1 is secured to an exterior door 31, which is hinged to a door facing 34 and is provided with a lockset doorknob 32 having a keyhole 33, as illustrated. The door 31 and door facing 34 are mounted in an exterior wall 35 of a structure and the door 31 opens into a room 36 to be illuminated. In a most preferred embodiment of the invention the illuminating apparatus 1 is secured to the door 31 above the keyhole 33 and is designed to illuminate the keyhole 33 by a downwardly directed beam of light 30. When the door is opened as illustrated in FIG. 1, a horizontally directed beam of light 10 projects into the room 36 to illuminate the room 36.

Figure 3:
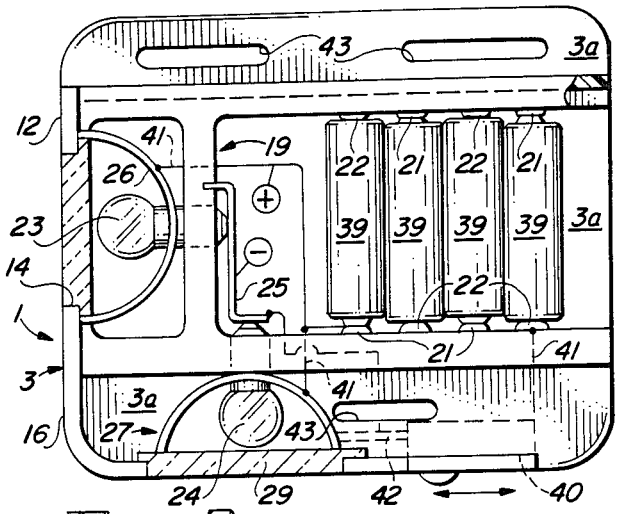
FIG. 3 is a sectional view taken along line 3—3 of the keyhole and room illuminating apparatus illustrated in FIG. 2.
Figure 4:
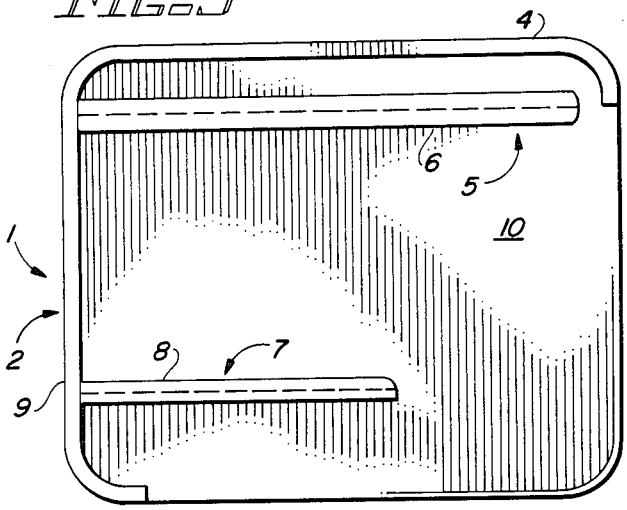
FIG. 4 is a sectional view taken along line 4—4 of the keyhole and room illuminating apparatus illustrated in FIG. 2.
Figure 2:
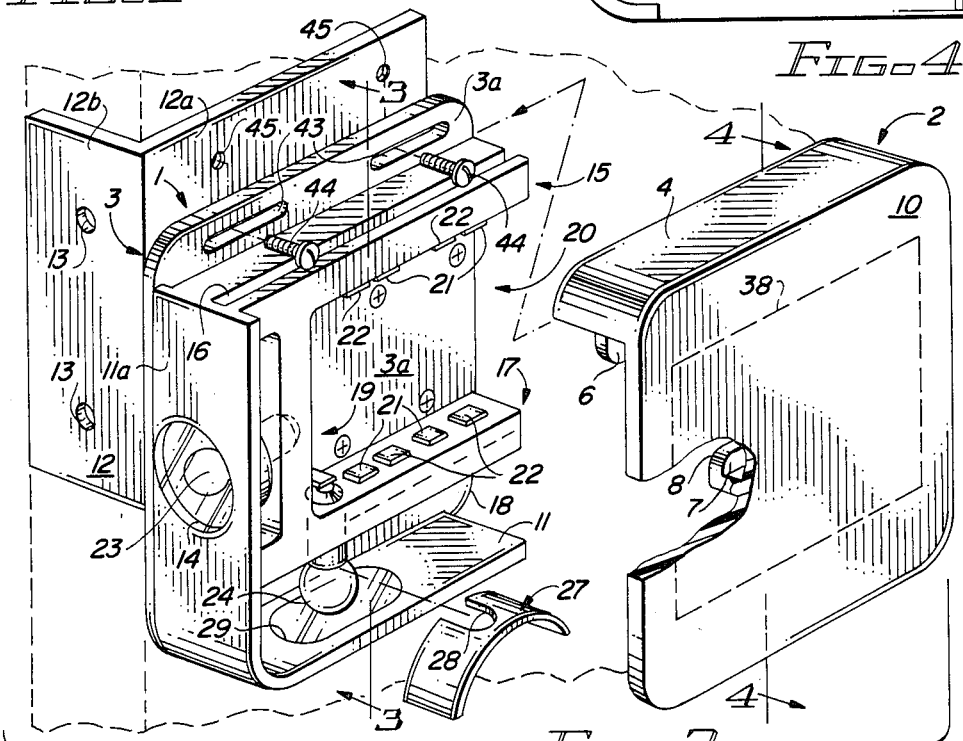
FIG. 2 is an exploded view of the keyhole and room illuminating apparatus illustrated in FIG. 1.
Figure 5:
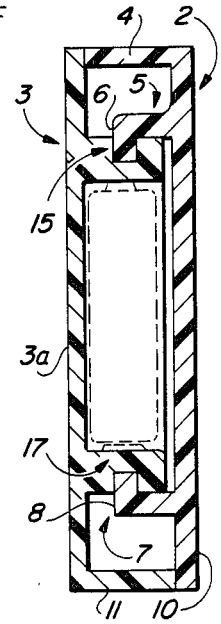
FIG. 5 is a side sectional view of the keyhole and room illuminating apparatus illustrated in FIG. 1.

Referring now to FIGS. 2–5 of the drawing in a most preferred embodiment of the invention the illuminating apparatus 1 is characterized by a shaped front housing 2 and a cooperating rear housing 3, which slidably fit together as illustrated in FIG. 5. The front housing 2 is further characterized by a flat front housing top 4 extending from a front housing plate 10, which front housing top 4 is fitted with a top tongue 5. The top tongue 5 is further provided with a downwardly extending top tongue flange 6. The front housing plate 10 is further provided with a bottom tongue 7 having a upwardly extending bottom tongue flange 8, which faces the top tongue flange 6 in spaced relationship. A front housing side 9 extends the front housing top 4 and the front housing top 4 and front housing side 9 project around approximately one-half of the perimeter of the front housing plate 10, as illustrated. The rear housing 3 is characterized by a flat rear housing bottom 11, which extends from a rear housing plate 3*a* and projects upwardly to shape a rear housing side 11*a*, which is provided with a room light aperture 14 therein. The rear housing bottom 11 and rear housing side 11*a* extend around substantially one-half of the perimeter of the rear housing plate 3*a*. In a most preferred embodiment of the invention the back flange 12*a* of an attachment plate 12 lies adjacent the rear housing plate 3*a* of the rear housing 3 and is provided with a pair of threaded holes 45. The threaded holes 45 receive a pair of adjusting bolts 44 and the side flange 12*b* of the attachment plate 12 is provided with plate apertures 13 for securing the illuminating apparatus 1 to the door 31. The adjusting slots 43, located in the rear housing plate 3*a*, also receive the adjusting bolts 44 to adjustably join the rear housing 3 to the attachment plate 12. Lateral adjustment of the rear housing 3 with respect to the attachment plate 12 is necessary in order to facilitate clearance of the rear housing 3 and front housing 2 with respect to door seating elements of the door facing 34 when the illuminating apparatus is mounted on the door 31. A top groove mount 15 is provided in the rear housing 3 and a top groove 16 is defined in the top groove mount 15, in order to receive the top tongue flange 6 of the top tongue 5, as illustrated in FIG. 5. Similarly, a bottom groove mount 17 and cooperating bottom groove 18 are provided in spaced relationship in the bottom portion of the rear housing 3, in order to accomodate the bottom tongue flange 8 of the bottom tongue 7, as further illustrated in FIG. 5. A vertical mount 19 spans the top groove mount 15 and the bottom groove mount 17 and together with the top groove mount 15 and bottom groove mount 17, defines a battery compartment 20 which is fitted with positive terminal connections 21 and negative terminal connections 22, in order to facilitate mounting of the batteries 39 as illustrated in FIGS. 2 and 3. A side bulb 23 is oriented in the vertical mount 19 and is provided with a side bulb reflector 26 which spans the room light aperture 14, such that side bulb 23 illuminates an extensive area horizontally outwardly of the room light aperture 14. A bottom bulb 24 is similarly oriented in the bottom groove mount 17 and is provided with a bottom bulb reflector 27, having a reflector slot 28, such that the bottom bulb 24 illuminates an area downwardly of the bottom aperture 29 in a vertical orientation. A negative contact bulb connector 25 is located inside the battery compartment 20 and extends from contact with the base of the side bulb 23 to the base of the bottom bulb 24. The negative contact bulb connector 25 is also fitted with positive and negative contact auxiliary connectors 41, which extend to the side bulb reflector 26 and the bottom bulb reflector 27 such that when the switch 40 makes positive contact with the bottom bulb reflector 27, the circuit is completed to the batteries 39 and both the side bulb 23 and the bottom bulb 24 are illuminated. The switch 40 is also electrically connected to the batteries 39 in conventional fashion to complete the electrical circuit.

In operation, referring again to the drawing, when it is desired to use the illuminating apparatus 1 the switch 40 is first manipulated to slide the switch contact 42 into engagement with the bottom bulb reflector 27, a switch position which completes the electrical circuit from the batteries 39 through the switch 40 and the bulb connector 25 and auxiliary connector 41, to the side bulb 23 and bottom bulb 24. This connection energizes the side bulb 23 and bottom bulb 24 and effects the vertical beam 30 and horizontal beam 37, as illustrated in FIG. 1. The vertical beam 30 enables a key (not illustrated) to be inserted in the keyhole 33 and the door 31 to be opened as illustrated. The horizontal beam 37 then projects into the room 36 thus illuminating the room 36 and enabling additional lighting to be provided in the room 36, as needed.

Referring again to FIG. 2 of the drawing in another preferred embodiment of the invention the front housing plate 10 of the front housing 2 is provided with a decorative panel, designated as reference numeral 38, in phantom. The decorative panel 38 can be designed according to the individual preference of the user.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An illuminating apparatus for illuminating a keyhole provided in a lockset mounted in a door and the room closed by the door, said illuminating apparatus comprising a split housing having front and rear housing sections; a pair of flanges carried by said front housing section in spaced, facing relationship; and a pair of grooves provided in said rear housing section in spaced, opposed relationship, whereby said flanges are adapted to engage said grooves and removably secure said front housing section to said rear housing section and further comprising an attachment plate carried by said rear housing section for mounting said illuminating apparatus; horizontally oriented adjusting slots provided in said rear housing section; threaded apertures provided in said attachment plate; and mount bolts projecting through said adjusting slots and threadibly engaging said threaded apertures, for securing said rear housing section to said attachment plate in horizontally adjustable relationship; a first aperture provided in one side of said split housing and a first bulb mounted in said split housing and facing said first aperture; a second aperture provided in the bottom of said split housing and a second bulb mounted in said split housing and facing said second aperture; at least one battery provided in said split housing and a switch mounted in said split housing; and electrical connectors provided in said split housing, said electrical connectors linking said first bulb, said second bulb, said battery and said switch, whereby said first bulb and said second bulb are illuminated responsive to manipulation of said switch.

2. The illuminating apparatus of claim 1 further comprising a first reflector mounted behind said first bulb and a second reflector mounted behind said second bulb in said housing, for reflecting light from said first bulb through said first aperture and from said second bulb through said second aperture, respectively.

* * * * *